US005472107A

United States Patent [19]

Lieber

[11] Patent Number: 5,472,107

[45] Date of Patent: Dec. 5, 1995

[54] COLLAPSIBLE CONTAINER

[76] Inventor: John H. Lieber, 2633 E. 26 Pl., Tulsa, Okla. 74114

[21] Appl. No.: 410,481

[22] Filed: Mar. 24, 1995

[51] Int. Cl.[6] ..... B65D 13/00

[52] U.S. Cl. ..... 220/6; 229/117.07

[58] Field of Search ..... 220/6; 229/117.07, 229/117.08

[56] References Cited

U.S. PATENT DOCUMENTS

| | | | |
|---|---|---|---|
| 70,598 | 11/1867 | Morgan . | |
| 156,470 | 11/1874 | Warner | 220/6 X |
| 1,202,253 | 10/1916 | Vitt | 220/6 |
| 2,346,466 | 4/1944 | Belsinger | 229/117.07 X |
| 2,547,628 | 4/1951 | Ellsworth | 229/117.07 |
| 2,998,181 | 8/1961 | Chasolen | 229/117.07 |
| 3,034,698 | 5/1962 | Forrer | 229/117.07 X |
| 3,376,994 | 4/1968 | Flinn, Jr. | 220/6 |
| 4,014,292 | 3/1977 | Coughlin et al. | 220/6 X |
| 4,331,231 | 5/1982 | Boyle | 229/117.07 X |
| 4,781,300 | 11/1988 | Long | 220/6 X |
| 5,195,677 | 3/1993 | Quintana et al. | 229/117.07 |
| 5,335,845 | 8/1994 | Liu | 229/120.18 |

*Primary Examiner*—Steven M. Pollard
*Attorney, Agent, or Firm*—Frank J. Catalano; Scott R. Zingerman

[57] ABSTRACT

A collapsible container has a substantially rectangular base and four substantially trapezoidal walls. The short parallel sides of the trapezoidal walls are foldably joined to a perimeter of the base and the non-parallel sides are foldably joined end-to-end. The lengthwise walls are foldably divided into three segments along lines extending from approximately a corner of the base at approximately a 45 degree angle toward approximately a center of their long parallel sides. The long parallel sides of the walls form an open mouth of the container larger than the base when the container is in an expanded condition. The base, the widthwise walls and the segments of the lengthwise walls are substantially parallel when the container is in a collapsed condition. Preferably, the container walls have a height greater than ½ the width of the base to as much as slightly more than an arm of a right isosceles triangle having a triangle base substantially equal to the width of the container base and the container base has a length approximately 1.5 times its width. The container is expandable and collapsible in response to rotational force applied to the widthwise walls. Preferably, the walls have sufficient weight to overcome forces inherent in the foldable junctions to maintain container in the expanded or collapsed condition. Also preferably, the base and the walls are of unitary construction.

14 Claims, 3 Drawing Sheets

COLLAPSIBLE CONTAINER

This invention relates generally to collapsible containers and more particularly concerns foldable baskets for laundry and the like.

Known containers which collapse to a substantially flat storage configuration are inconvenient or inefficient for use as laundry baskets and the like. They are typically orthogonal in configuration and since the sides are vertical, their mouths are relatively small, and the vertical sidewalls tend to cause articles directed into them to fall out of the basket as easily as into it, making them difficult to load. Furthermore, the vertical sides also generally result in wasted space along the base perimeter of the basket. Moreover, in presently known folding arrangements, the containers typically have a height of not more than half the width of their base and frequently considerably less than half the width of their base. This greatly reduces the capacity of the basket.

To avoid some of these problems, baskets have been designed having wider mouths than bases and greater depths to increase capacity. To accomplish this, however, disassembly of the components is typically required to achieve the substantially flat storage condition. See, for example, the basket illustrated in U.S. Pat. No. 4,781,300 issued to Long. While this basket solves the above mentioned problems, it results in time consuming assembly and disassembly for each use and storage of the basket so as to make the basket impractical.

It is, therefore, an object of this invention to provide a collapsible container of unitary construction. A further object of this invention is to provide a collapsible container having a mouth significantly larger than its base. Yet another object of this invention is to provide a collapsible container having a depth significantly greater than half the width of its base. It is also an object of this invention to provide a collapsible container configured to facilitate loading and unloading of articles such as laundry. Still another object of this invention is to provide a collapsible container configured to maximize use of its volume in receiving articles such as laundry. And it is an object of this invention to provide a collapsible container which folds into a substantially flat configuration for storage.

SUMMARY OF THE INVENTION

In accordance with the invention, a collapsible container is provided which has a substantially rectangular base and four substantially trapezoidal walls. The short parallel sides of the trapezoidal walls are foldably joined to a perimeter of the base and the nonparallel sides are foldably joined end-to-end. The lengthwise walls are foldably divided into three segments along lines extending from approximately a corner of the base at approximately a 45 degree angle toward approximately a center of their long parallel sides. The long parallel sides of the walls form an open mouth of the container larger than the base when the container is in an expanded condition. The base, the widthwise walls and segments of the lengthwise walls are substantially parallel when the container is in a collapsed condition. Preferably, the container walls have a height greater than ½ the width of the base to as much as slightly more than an arm of a right isosceles triangle having a triangle base substantially equal to the width of the container base and the container base has a length approximately 1.5 times its width. The container is expandable and collapsible in response to rotational force applied to the widthwise walls. Preferably, the walls have sufficient weight to overcome forces inherent in the foldable junctions to maintain container in the expanded or collapsed condition. Also preferably, the base and the walls are of unitary construction.

BRIEF DESCRIPTION OF THE DRAWINGS:

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
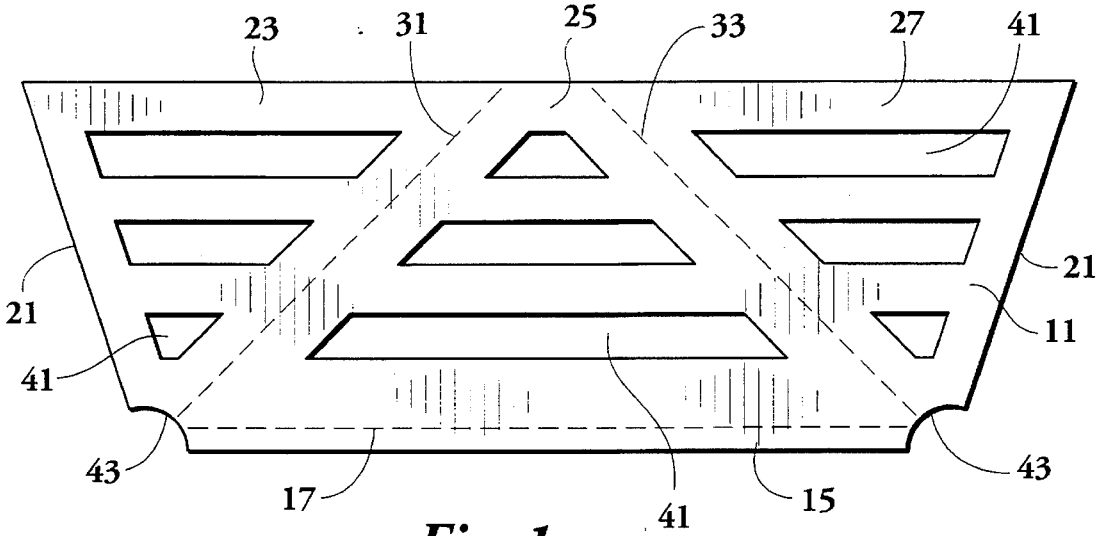
FIG. 1 is an elevation view of a typical front or back panel of the collapsible container.
Figure 2:
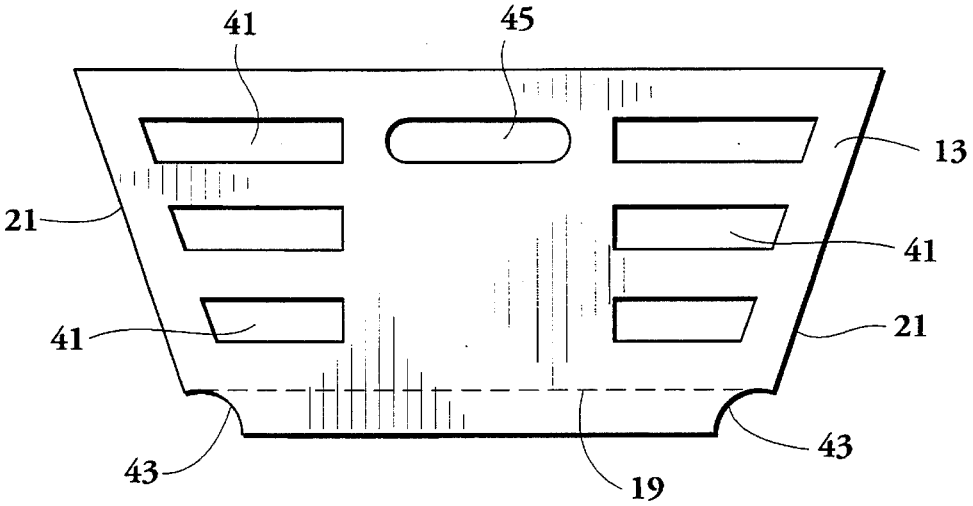
FIG. 2 is an elevation view of a typical side panel of the collapsible container.
Figure 8:
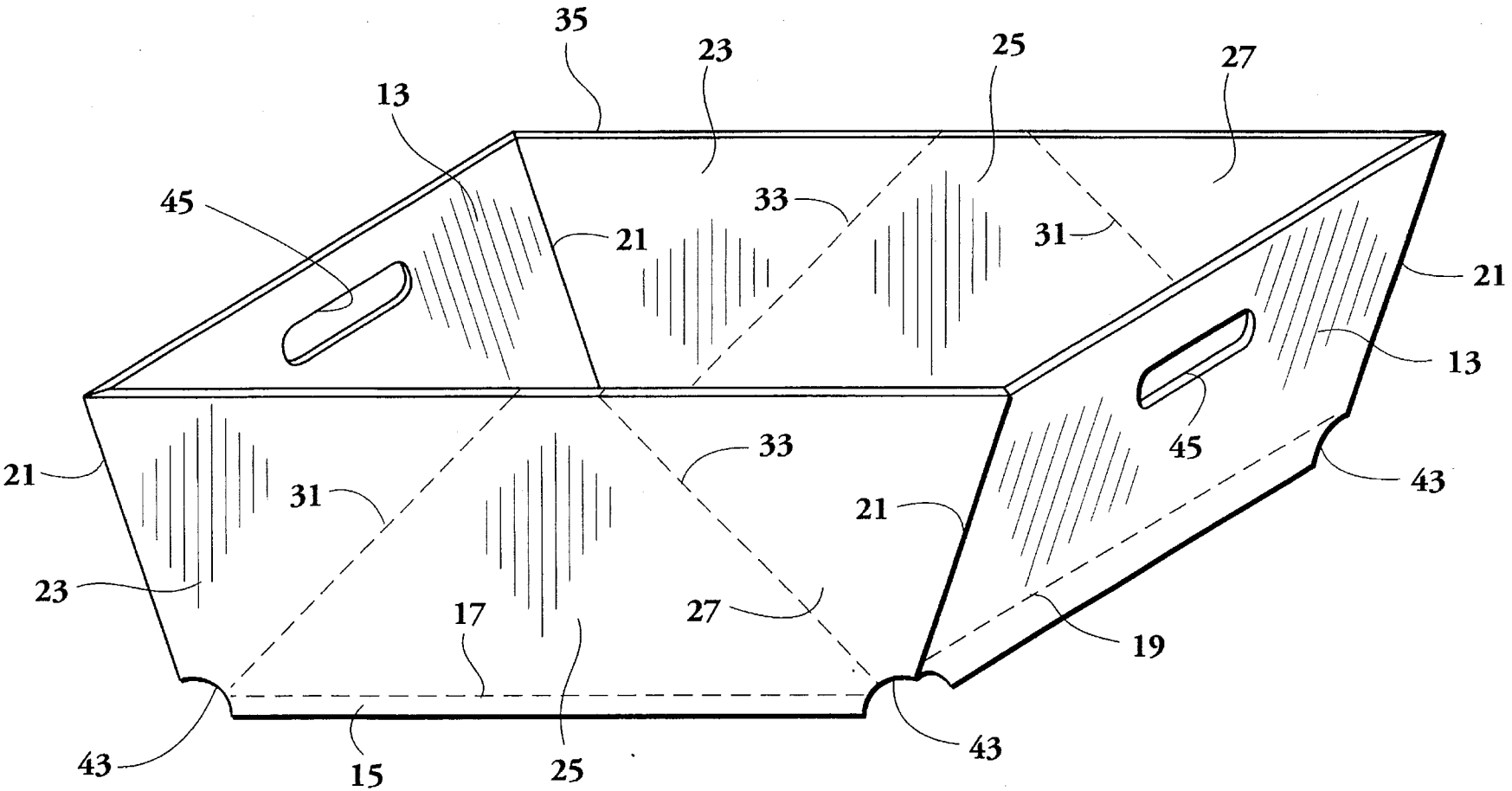
FIG. 8 is a perspective view of the collapsible container in the fully expanded condition.

DETAILED DESCRIPTION OF THE INVENTION:

Turning first to FIGS. 1, 2 and 8, a preferred embodiment of the collapsible basket is illustrated consisting of a pair of trapezoidal front and back walls 11 and a pair of trapezoidal side walls 13. The short parallel sides of each of the walls 11 and 13 are foldably joined to the perimeter of a base 15, the lengthwise walls being joined along a hinge line 17 to the base 15 at the top edge of the base 15 and the widthwise walls being joined to the base 15 along a hinge line 19 approximately twice as high as the lengthwise hinge lines 17. The non-parallel sides of the walls 11 and 13 are foldably joined end-to-end along corner hinge lines 21.

As is best seen in FIGURES 1 and 8, the lengthwise walls 11 are foldably divided into three segments 23, 25 and 27 along hinge lines 31 and 33 which extend from approximately the lower corners of the container at approximately a 45 degree angle toward approximately the center of the long parallel sides of the lengthwise walls 11. When the container is in the fully expanded condition shown in FIG. 8, the long parallel sides of the walls 11 and 13 form an open substantially rectangular mouth 35 for the container which is larger than the base 15.

Figure 3:
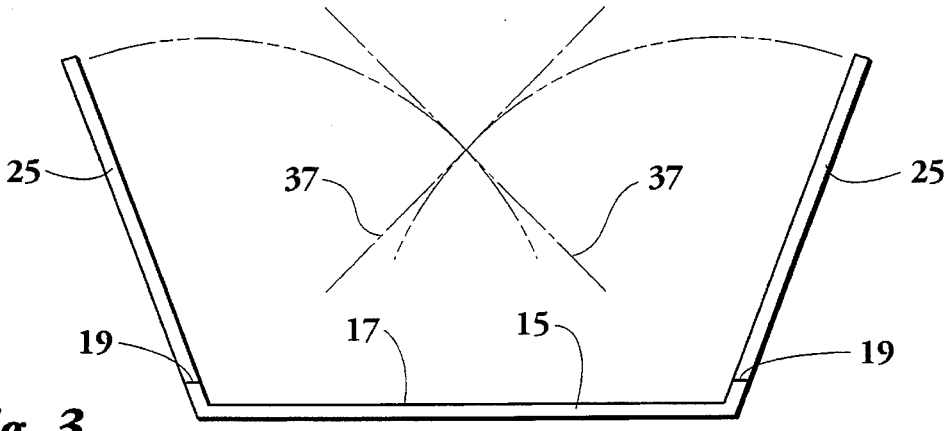
FIG. 3 is a cross sectional view taken across the width of the collapsible container illustrating the relationship of its height to the width of its base.

Looking now at FIG. 3, if the lengthwise walls 11 are to fold in a fully collapsed condition into substantially parallel relationship with the base 15, the height of the walls 11 will at a maximum be substantially equal to an arm 37 of a right isosceles triangle having a triangle base substantially equal to a width of the container base 15. This permits the walls 11 to clear each other as the uppermost points of the middle segments 25 of the lengthwise walls 11 rotate into perpendicular relationship to each other. Depending on the flexibility of the container material, the height of the walls 11 may slightly exceed this length.

Figure 4:
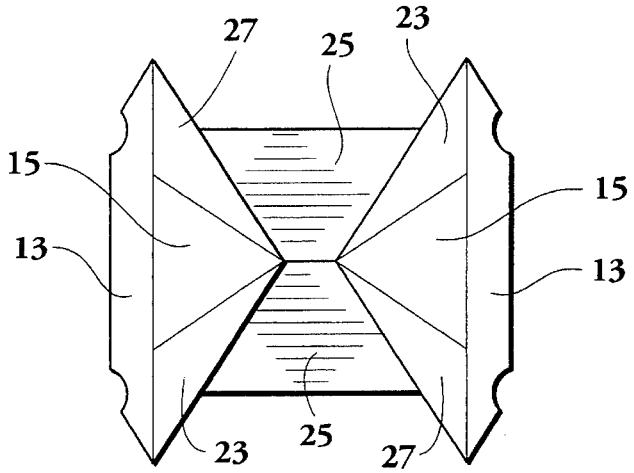
FIG. 4 is a top plan view illustrating the collapsible container in a partly collapsed condition.

As shown in FIG. 4, the container is in a partially collapsed condition in which the middle segments 25 of the lengthwise walls 11 are in the substantially perpendicular relationship above described. The middle segments 25 are moving inwardly toward substantially parallel relationship with the base 15 and the outer segments 23 and 27 are moving outwardly toward substantially parallel relationship with the middle segments 25. The widthwise walls 13 are moving inwardly toward substantially parallel relationship with the outer segments 23 and 27 of the lengthwise walls 11.

Figure 5:
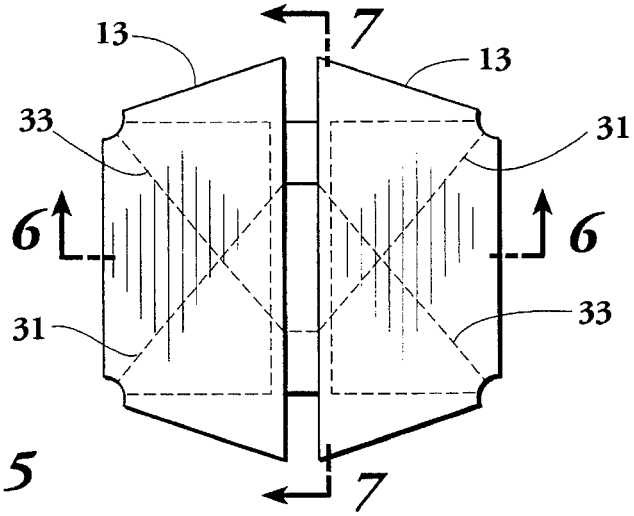
FIG. 5 is a top plan view illustrating the collapsible container in the fully collapsed condition.
Figure 6:
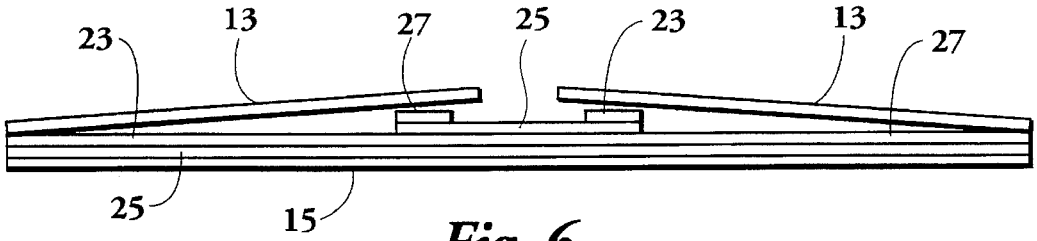
FIG. 6 is a cross-sectional view taken along the lines 6—6 of FIG. 5.
Figure 7:
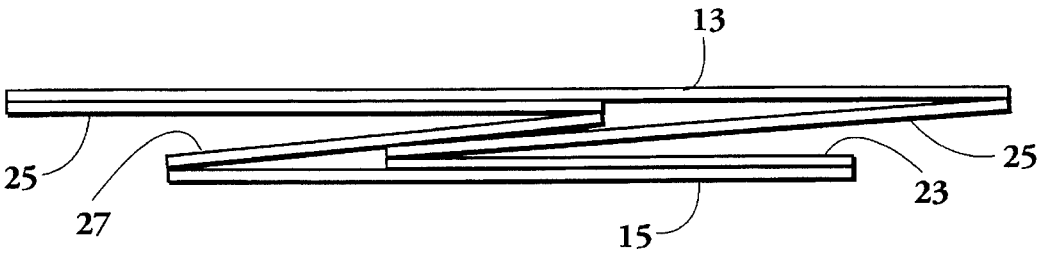
FIG. 7 is a cross-sectional view taken along the lines 7—7 of FIG. 5.

In FIGS. 5, 6 and 7 the container is shown in its fully collapsed condition. As can best be seen in FIGS. 6 and 7, as the middle segments 25 rotate past their perpendicular relationship, the segments 23, 25 and 27 of one of the lengthwise walls 11 slip under the segments 23, 25 and 27 of the other lengthwise wall 11 so that all of the walls 13, segments 23, 25 and 27 and base 15 are almost or substantially but not perfectly parallel. However, the container is collapsed to a sufficient extent as to be readily storable in a narrow space, such as between closely spaced washers and dryers or under an appliance or between an appliance and a wall.

In a preferred embodiment, the walls 11 and 13 will have a height at least as great as ½ the width of the base 15 and the base 15 will have a length approximately 1.5 times its width. It is also desirable that the triangular and trapezoidal components be isosceles and also that the angles of all the isosceles components be equal. The middle segments 25 may be either triangular or trapezoidal, though a trapezoidal configuration of relatively small short parallel side is preferred. It is especially useful that, given identicity of the base angles, the short parallel side of the lengthwise walls 11 is equal to the long parallel side of the widthwise walls 13. This will permit the walls 11 and 13 to be cut from single isosceles triangles if non-unitary construction is employed. As shown in FIGS. 1 and 2, the walls may have apertures 41 to minimize the amount of material used to form the container. Preferably, the container will be of unitary plastic construction with thinner wall portions defining the hinge or fold lines. However, other materials or hinging arrangements may be used without deviating from the principles of the invention. Portions of the bottom corners 43 of the container may also be removed or omitted to facilitate folding. Preferably, the widthwise walls 13 are provided with handles 45 for carrying and manipulating the container. As rotational force is applied inwardly or outwardly to the widthwise walls 13, the container will collapse or expand to its storage and use conditions, respectively. Preferably, the weight of the walls 11 and 13 is coordinated to the forces inherent in the selected foldable junctions to maintain the container in the fully collapsed or fully expanded condition.

Thus, it is apparent that there has been provided, in accordance with the invention, a collapsible container that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A collapsible container comprising a substantially rectangular base and four substantially trapezoidal walls having short parallel sides foldably joined to a perimeter of said base and non-parallel sides foldably joined end-to-end, lengthwise ones of said walls being foldably divided into three segments along lines extending from approximately a corner of said base at approximately a 45 degree angle toward approximately a center of long parallel sides thereof, said long parallel sides forming an open mouth of said container larger than said base when said container is in an expanded condition and said base, widthwise ones of said walls and said segments of said lengthwise ones of said walls being substantially parallel when said container is in a collapsed condition.

2. A container according to claim 1, said walls having a height greater than ½ a width of said base.

3. A container according to claim 2, said walls having a height less than or equal to an arm of a right isosceles triangle having a triangle base substantially equal to a width of said container base.

4. A container according to claim 3, said base having a length approximately 1.5 times a width thereof.

5. A container according to claim 3, said trapezoidal walls being isosceles.

6. A container according to claim 5, said isosceles walls having substantially equal base angles.

7. A container according to claim 6, said widthwise walls having long parallel sides substantial equal to shod parallel sides of said lengthwise walls.

8. A container according to claim 3, said segments being isosceles.

9. A container according to claim 8, said segments being triangular.

10. A container according to claim 8, outer ones of said segments being triangular and a middle one of said segments being trapezoidal.

11. A container according to claim 1, said container being expandable and collapsible in response to rotational force applied to said widthwise walls.

12. A container according to claim 1, said walls having sufficient weight to overcome forces inherent in said foldable junctions to maintain said container in said expanded condition.

13. A container according to claim 1, said walls having sufficient weight to overcome forces inherent in said foldable junctions to maintain said container in said collapsed condition.

14. A container according to claim 1, said base and said walls being of unitary construction.

* * * * *